US008819876B2

(12) United States Patent
Dabrowski et al.

(10) Patent No.: US 8,819,876 B2
(45) Date of Patent: Sep. 2, 2014

(54) INTERCHANGEABLE TUB AND SHOWER ACCESSORIES

(75) Inventors: Peter Dabrowski, Macomb, MI (US); Michael Krushlin, Westland, MI (US)

(73) Assignee: Masco Corporation of Indiana, Indianapolis, IN (US)

( * ) Notice: Subject to any disclaimer, the term of this patent is extended or adjusted under 35 U.S.C. 154(b) by 1233 days.

(21) Appl. No.: 11/736,793

(22) Filed: Apr. 18, 2007

(65) Prior Publication Data

US 2007/0240259 A1 Oct. 18, 2007

Related U.S. Application Data

(60) Provisional application No. 60/792,863, filed on Apr. 18, 2006.

(51) Int. Cl.
*A47K 3/00* (2006.01)

(52) U.S. Cl.
USPC ..... 4/614; 4/612; 4/613; 4/548; 4/628; 4/559; 4/605; 211/119.009; 211/119.011

(58) Field of Classification Search
USPC ..... 4/559, 605, 628, 612–614, 661, 546, 4/548, 549; 211/87.01, 88.01, 90.01, 211/192, 193, 119.009, 119.011; 248/220.21, 225.11, 225.21
See application file for complete search history.

(56) References Cited

U.S. PATENT DOCUMENTS

| | | | | | |
|---|---|---|---|---|---|
| 345,918 | A | * | 7/1886 | Palmer | 4/559 |
| 1,709,144 | A | * | 4/1929 | Mueller | 248/222.11 |
| 3,609,773 | A | * | 10/1971 | Mustee | 4/605 |
| 3,684,102 | A | * | 8/1972 | Colter | 211/88.01 |
| 3,698,565 | A | * | 10/1972 | Weber | 211/87.01 |
| 3,873,151 | A | * | 3/1975 | Morris et al. | 297/14 |
| 4,327,961 | A | * | 5/1982 | Kladitis | 359/512 |
| 4,398,309 | A | * | 8/1983 | Simons | 4/605 |
| 4,536,995 | A | * | 8/1985 | Frederick | 52/27 |
| 5,060,898 | A | | 10/1991 | Chang | |
| 5,100,213 | A | * | 3/1992 | Vandarakis et al. | 312/405 |
| 5,178,353 | A | | 1/1993 | Huxtable | |
| 5,312,179 | A | * | 5/1994 | Schlaud et al. | 312/242 |
| 5,360,121 | A | * | 11/1994 | Sothman | 211/87.01 |
| 5,921,514 | A | * | 7/1999 | Schumann | 248/205.3 |
| 6,196,607 | B1 | * | 3/2001 | Gulisano | 296/39.1 |
| 6,431,386 | B1 | | 8/2002 | Hofman et al. | |
| 7,096,519 | B2 | * | 8/2006 | Ferreri et al. | 4/596 |
| 7,243,806 | B2 | * | 7/2007 | Kwok | 211/105.3 |
| 7,392,551 | B2 | * | 7/2008 | Lanius | 4/608 |

(Continued)

OTHER PUBLICATIONS

International Search Report and Written Opinion mailed Aug. 21, 2007.

International Preliminary Report on Patentability mailed on Oct. 30, 2008.

*Primary Examiner* — Tuan N Nguyen

*Assistant Examiner* — Erin Deery

(74) *Attorney, Agent, or Firm* — Carlson, Gaskey & Olds, P.C.

(57) ABSTRACT

An example shower assembly includes a mount for removeably securing and supporting an accessory item to a shower wall. The mounts are permanently attached to the shower wall and are spaced apart a set desired distance. Slots on the accessory item receive the mounts to support the accessory item firmly and substantially rigidly to the shower wall. Removal of the accessory item is performed by lifting to allow installation of another accessory item as desired.

7 Claims, 7 Drawing Sheets

(56) References Cited

U.S. PATENT DOCUMENTS 7,931,161 B2 * 4/2011 Newbould et al. ..... 211/106
8,096,000 B2 * 1/2012 Helmetsie et al. ..... 4/614
2002/0017499 A1 * 2/2002 Bengoechea ..... 211/90.01

* cited by examiner

INTERCHANGEABLE TUB AND SHOWER ACCESSORIES

CROSS REFERENCE TO RELATED APPLICATION

The application claims priority to U.S. Provisional Application Ser. No. 60/792,863 that was filed on Apr. 18, 2006.

BACKGROUND OF THE INVENTION

This invention generally relates to tub and shower enclosure. More particularly, this invention relates to a tub and shower enclosure including swappable accessory items.

A shower or tub will typically include accessory items such as soap dishes, towel racks and shampoo container holders for example. Conventional accessory items are permanently affixed to the tub or shower and are not changeable without potential damage to the tub and shower walls. Further, different permanently attached accessories typically require different mounting configurations that are adapted to the specific size and shape of that particular accessory. The many different shapes result in the inability to swap out or easily change accessory items.

Further, consumers often are hesitant to drill holes into the shower and tub stalls. Adhesives are not a desirable alternative as clean up and removal is most often difficult. Some after market alternatives utilize suction cups that do not harm the shower walls, but that do not provide a permanent steady look or feel. Currently available shower caddies and organizers are designed to mount in a number of ways including hanging over shower heads, hanging over glass walls, suction cups, glue on hooks, mechanically mounted hooks, poles that telescope between the tub floor and ceiling, or stand on the tub floor. Such after market accessory items have a generic look and feel that is not designed or built to provide a pleasing aesthetic appearance.

Accordingly, it is desirable to design and develop features for a shower and tub surround that provide for changing of various accessory items in a simplified manner.

SUMMARY OF THE INVENTION

An example shower assembly includes mounts for removable securing and supporting accessory items to a shower wall.

The example accessory item, such as for example a soap dish, is removeably fastened to a shower wall. The mounts are permanently attached to the shower wall and are spaced apart a set desired distance. Slots on the accessory item receive the mounts to support the accessory item firmly and substantially rigidly to the shower wall. Removal of the accessory item is accomplished by lifting the accessory item free of the mounts to allow installation of another accessory item as desired. Each of the accessory items include slots or other mating features corresponding to the mounts for removeably securing the accessory item to the shower wall.

Accordingly, many different accessory items can be selected and mounted within a shower assembly to provide a desired look and permanent feel, while still allowing removal and reinstallation of other desired accessory items.

These and other features of the present invention can be best understood from the following specification and drawings, the following of which is a brief description.

BRIEF DESCRIPTION OF THE DRAWINGS

The features of the present invention can be best understood from the following specification and drawings, the following of which is a brief description.

DETAILED DESCRIPTION OF THE PREFERRED EMBODIMENT

Figure 1:
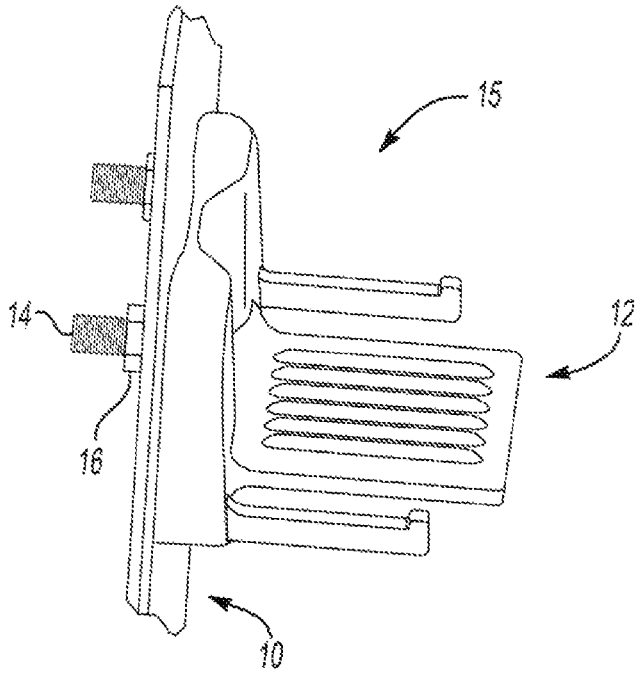
FIG. 1 is a perspective view of an example swappable accessory mounted to a shower wall.
Figure 2:
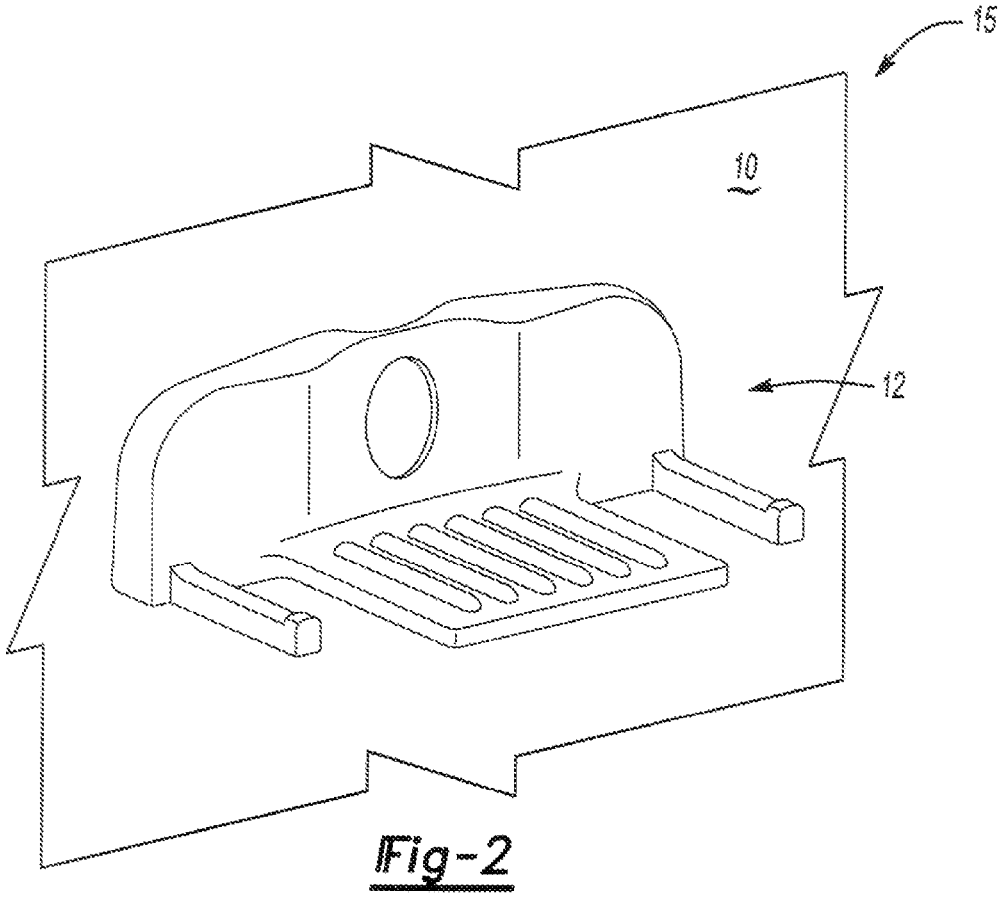
FIG. 2 is another perspective view of the example accessory attached to the shower wall.
Figure 3:
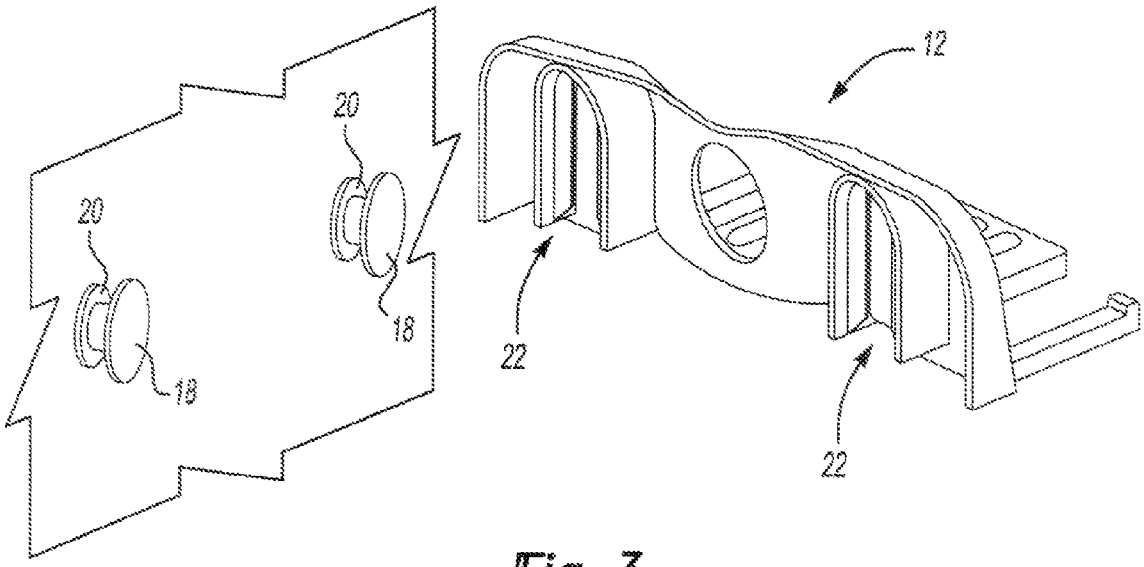
FIG. 3 is rear view of the example swappable accessory and example mounting hooks.

Referring to FIGS. 1-3, an example shower accessory assembly 15 includes a soap dish 12 that is removeably fastened to a shower wall 10. A pair of mounts 18 are attached to the shower wall 10 with a threaded fastener including a threaded stud 14 that is part of the mount 18 and a corresponding nut 16. The mounts 18 are spaced apart a set desired distance. The soap dish 12 includes slots 22 that fit into recess 20 of the mounts 18 to hold the soap dish 12 firmly and substantially rigidly to the shower wall 10. The slots 22 are spaced apart the same distance as the mounts 18 to provide a common compatible mounting configuration. Other accessory items with slots spaced the same distance are attachable to the same mounts 18.

Figure 4:
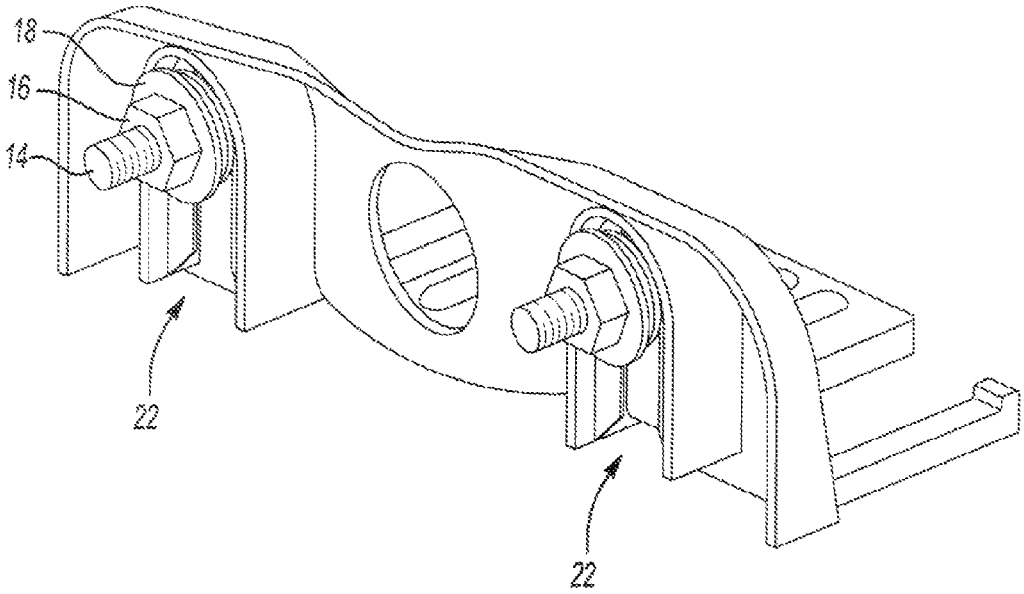
FIG. 4 is a rear schematic view of the example accessory engaged to the example hooks.
Figure 5:
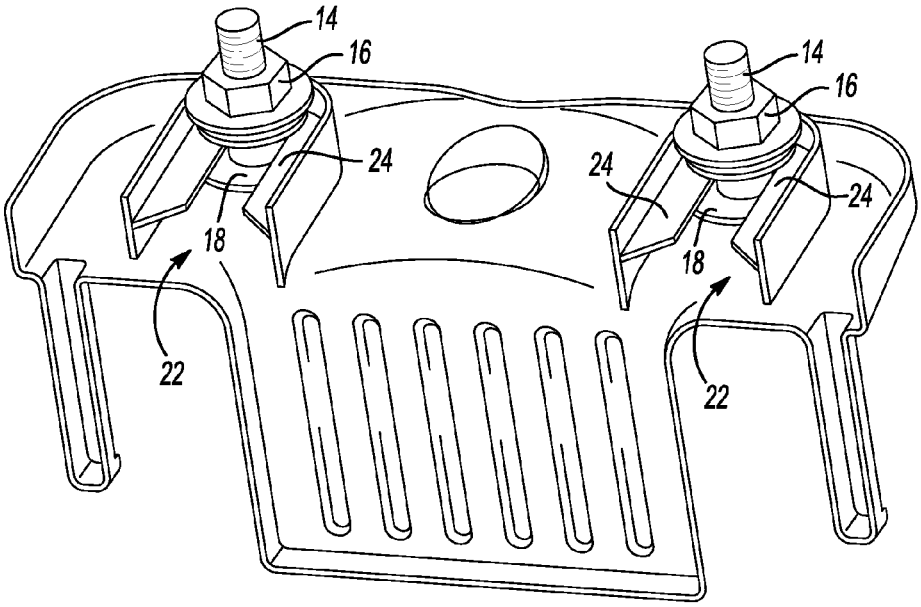
FIG. 5 is another schematic view of the example accessory engaged to the example mount.

Referring to FIGS. 4 and 5, the slots 12 in the soap dish 12 include ribs 24 that extend inwardly into the slit 22 to secure the mount 18 therein. The ribs 24 are sloped such that securement of the soap dish 12 is provided by seating the mounts 18 firmly within the slots 22. As the mounts 18 are received within the slots 22 the sloping configuration of the ribs 24 draw the soap dish closer to the shower wall 10 to provide a substantially positive and rigid contact and fit. Once the mounts 18 are seated at the end of the slot 24, the ramped configuration provides a light press fit against the shower wall 10. The light press fit is provided in a magnitude that provides the desired rigid feel while still providing for removal with the application of a reasonable amount of force.

Figure 6:
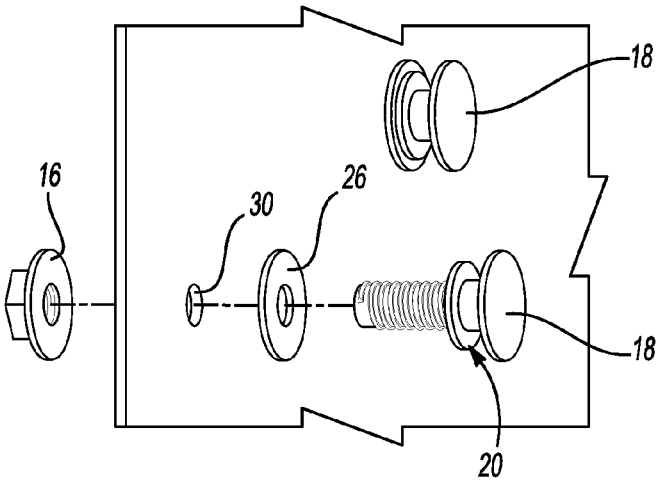
FIG. 6 is a schematic view of an example mount securement configuration.

Referring to FIG. 6, the mount 18 is secured to the shower wall 10 through an opening 30. The example mount 18 illustrated in FIG. 6 includes the threaded stud 14 that extends through the shower wall 10 and that is engaged with the nut 16 on a back side of the shower wall. A seal 26 is provided between the mount 18 and the shower wall 10 to control potential leakage through the opening 30. The seal 26 comprises an adhesive that provides the sealing function and also aids in supporting the mount 18.

Figure 7:
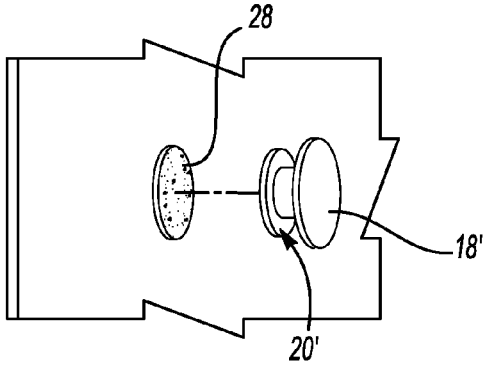
FIG. 7 is a schematic view of another example mount securement configuration.

Referring to FIG. 7, another amount 18' is shown that is configured for mounting without a threaded fastener. An adhesive patch 28 is utilized to affix the mount 18' to the shower wall 10. The adhesive patch 28 is comprised of an adhesive that is compatible with the shower environment and that includes sufficient strength to hold the desired accessory in place. The use of the adhesive patch 28 provides for assembly and mounting of the mount 18' in applications where the back side of the shower wall 10 is not easily accessible.

Figure 8:
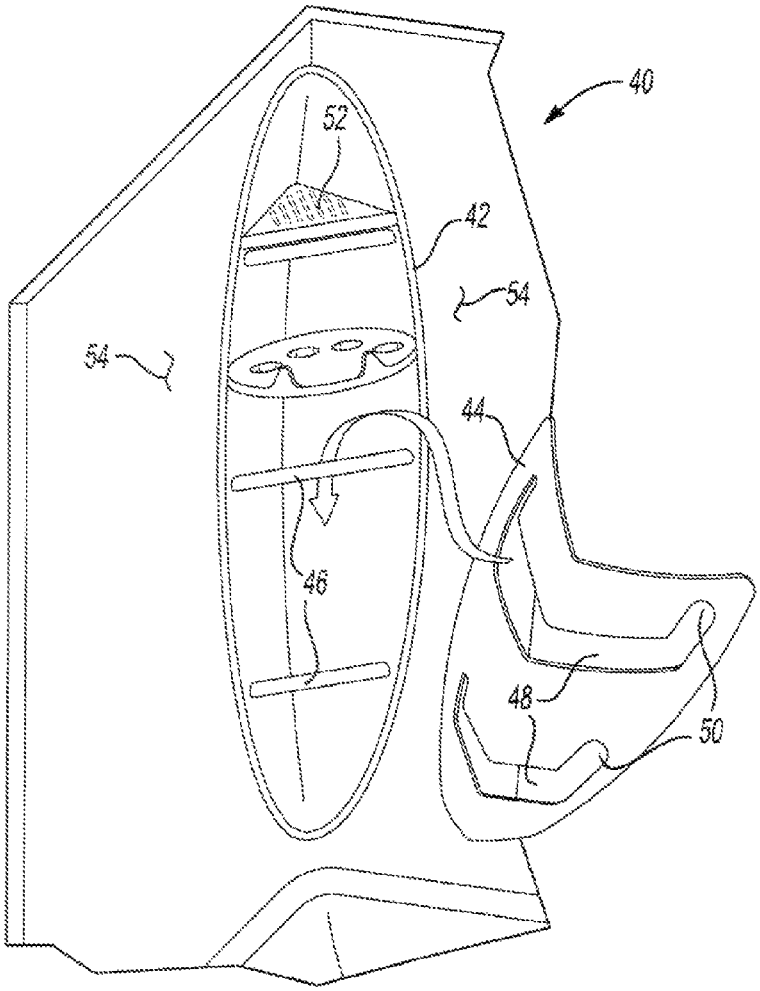
FIG. 8 is a schematic view of another swappable accessory and an example mounting bar.
Figure 9:
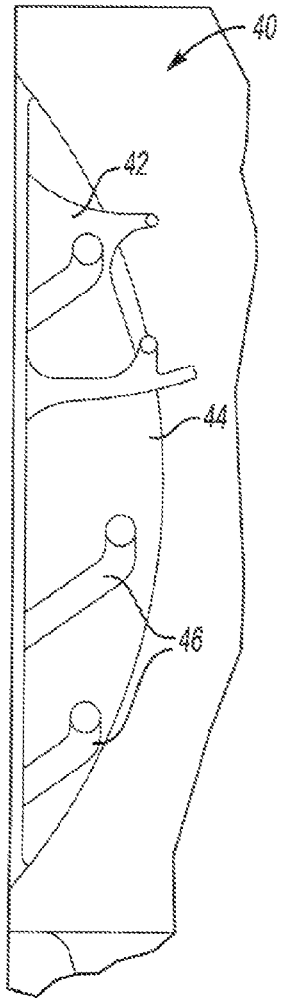
FIG. 9 is a side view of the example swappable accessory of FIG. 8.

Referring to FIGS. 8 and 9, another example shower accessory assembly 40 includes mounting bars 46 that extend between adjacent shower walls 54. The mounting bars 46 may be dedicated mounting bars 46 or may be towel bars provided with the shower surround assembly. The mounting bars 46 are spaced a standard distance apart that corresponds with a distance between slots 48 of a shower accessory. The example illustrated includes a top soap dish accessory 42 and a bottom cover accessory 44. Both accessories include the slot 48 with a locking portion. Mounting is accomplished by aligning the slots 48 with the mounting bars 46 and pushing or pulling downward to move the corresponding bar 46 into the locking portion 50 of the slot 48. In this manner, existing towel or grab bars can be utilized for the mounting of contoured and fitted accessory devices to provide a desired appearance.

Figure 10:
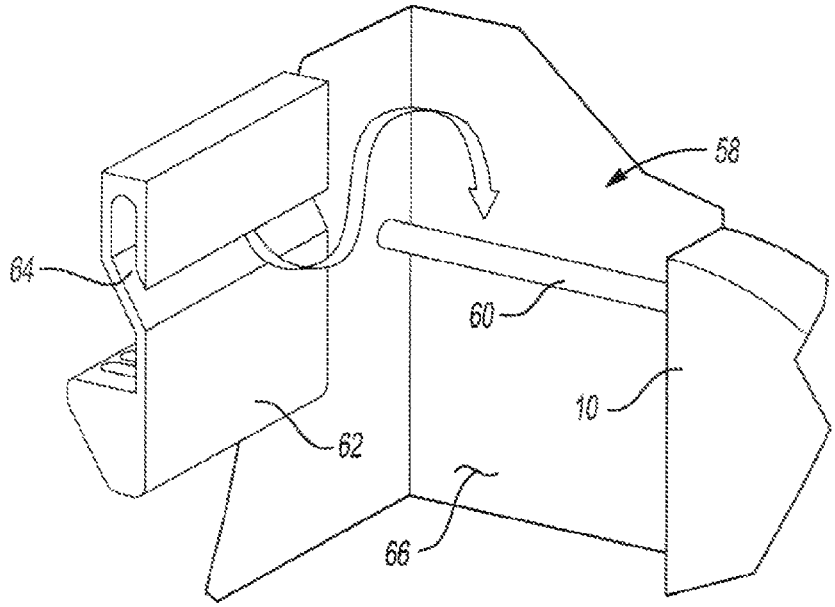
FIG. 10 is a schematic view of another example swappable accessory and example mounting bar.
Figure 11:
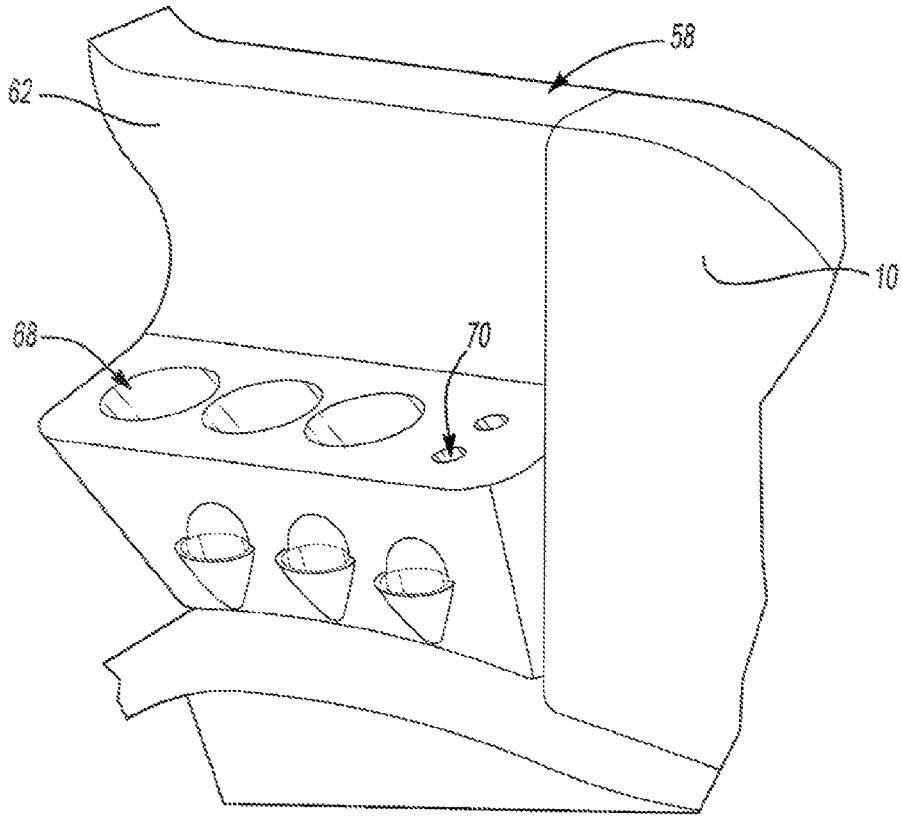
FIG. 11 is a schematic view the example swappable accessory mounted to the shower wall.
Figure 12A:
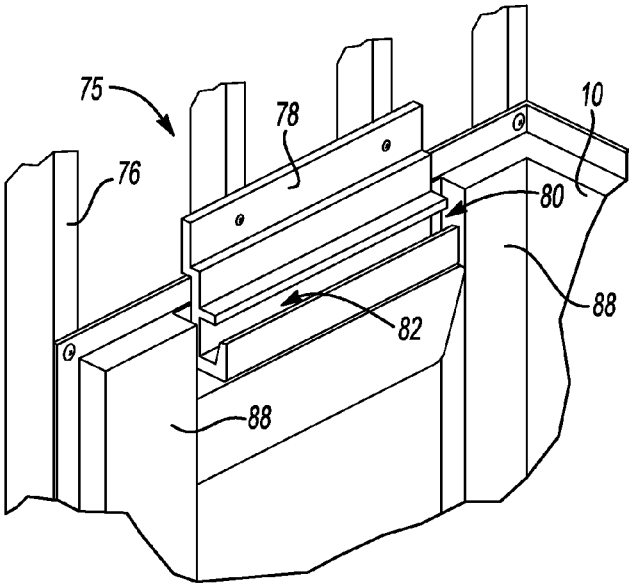
FIG. 12A is a schematic view of roughed in example mounting bracket.
Figure 13:
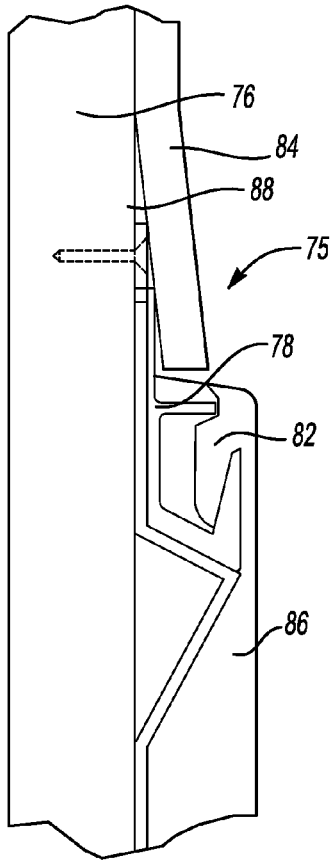
FIG. 13 is a side view of the example mounting bracket.
Figure 12B:
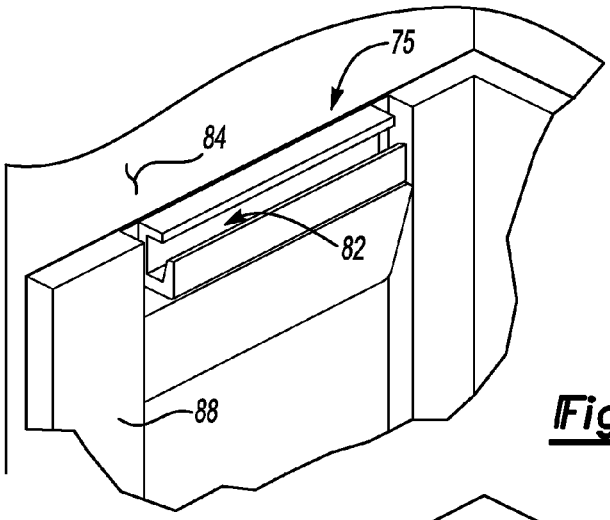
FIG. 12B is a schematic view of the example mounting bracket with installed drywall.
Figure 12C:
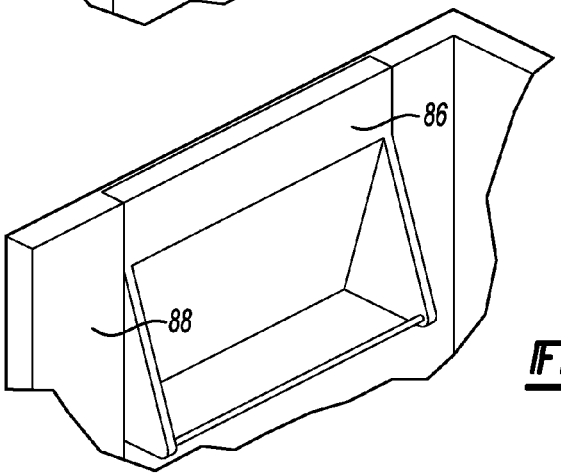
FIG. 12 C is a schematic view of the example mounting bracket installed within the shower wall.

Referring to FIGS. 10 and 11 another shower accessory assembly 58 includes a recessed area 66 with an existing towel bar 60. Although a towel bar 60 illustrated by way of example, other existing bars such as a grab bar or other existing shower attachments could be utilized for mounting the shower accessory item. A shower accessory 62 includes a groove 64 that receives the mounting bar 60 to lock the shower accessory 62 in place. The shower accessory 62 fits within the recessed area 66 to provide a desirable built in look. The shower accessory 62 includes openings 68 for holding various sizes of shampoo or other bottles commonly stored within a shower. Further, the shower accessory 62 includes smaller openings 70 for shaving utensils or other commonly utilized devices. The recessed area 66 provides for a substantially uninterrupted surface of the shower wall to provide a desired pleasing appearance.

Referring to FIGS. 12A, 12B, 12C and 13, another shower accessory assembly 75 includes a mounting bracket 78 that is installed during rough in of the shower surround wall 88. The mounting bracket 78 mounts directly to wall studs 76 supporting the shower surround wall 88. The mounting bracket 78 includes a portion that extends over a top edge of the shower wall 88 during fastening directly to the wall studs 76. The shower wall 88 is different than the wall board 84 and extends only part way between the floor and ceiling. The space between the shower wall 88 and ceiling is standard wall board 84.

The bracket 78 further includes a lip 82 that receives an edge of the wall board attached to the wall studs 76. The mounting bracket 78 includes a flange that is covered by drywall 84 in the final assembly. The drywall 84 overlaps the flange of the mounting bracket 78 along with flanges of the shower walls 88 to provide the desired look and mounting. The direct mounting of the mounting bracket 78 to the studs 76 provides for the support of accessories of substantial weight and size. Further, any load of the shower accessory is supported on the studs 76 and not supported by the shower walls 88.

Installation includes the step of securing the bracket 78 to the studs 76 such that a portion of the bracket 78 overlaps a portion of the shower wall 88. This is accomplished during a rough-in building phase after the shower wall 88 is installed, but before the final portion of wall board 84 is installed. Dry wall or other wall board 84 is then installed and fits over a portion of the bracket 78. The bracket 78 thereby extends from the studs 76 through a seam between adjacent the shower wall 88 and the wall board 84. The shower wall 88 is then assembled and attached over the wall board 84 and the bracket 78. The bracket 78 is thereby substantially permanently mounted to support the accessory 86.

Figure 14:
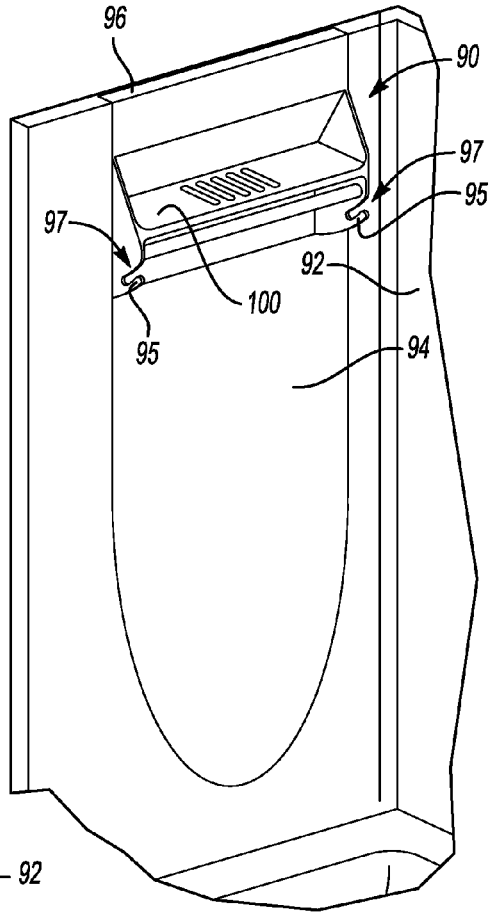
FIG. 14 is a schematic view of another swappable accessory.
Figure 15:
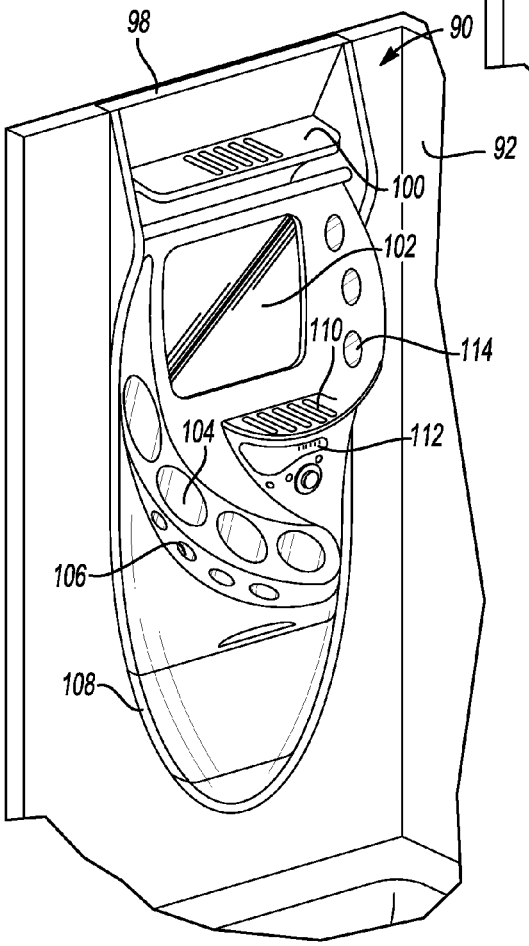
FIG. 15 is a schematic view of yet another swappable accessory.

Referring to FIGS. 14 and 15, the bracket 78 can be utilized in concert with an example shower assembly 90 that includes a recess 94 that corresponds with the placement of the bracket 78. The recess 94 provides a desired contoured shape within which a first accessory 96 can be mounted that includes features such as a soap dish 100 and a towel bar. The first accessory 96 further includes arms 95 that are spaced horizontally apart within the recess 94. The arms 95 define corresponding slots 97. The first accessory 96 can be removed and replaced with a second accessory 98 that includes many more features in addition to the soap dish 100. The second accessory 98 extends downwardly and substantially fills the entire recess 95.

The second accessory 98 includes a mirror 102, several openings 104 for shampoo and other bottles, smaller openings 106 for shavers and other smaller objects, a covered compartment 108 for housing shower gels and the like that are dispensed at the push of a button. The second accessory 98 is supported by the arms 95 and fits within the slots 97. Further the accessory includes a clock radio 112 and additional openings 114 for still more objects for use in the shower. The recessed space 94 encourages a consumer to obtain more elaborate and larger shower accessories to fill the available space 94.

As should be appreciated, the shower accessory can include many different features to support various shower products and consumer desires. Each shower accessory is fit tightly and snugly against the shower wall to provide the look and feel of a permanent shower accessory, while providing for the swapping of new and updated shower accessories as needs and desires change.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A shower assembly comprising:

a shower including a first wall and a second wall that form a corner;

a mount comprising a bar attached to the first wall and the second wall that extends diagonally across the corner; and an accessory structure removeably supported on the bar of the mount and including an outer profile corresponding with the corner formed between the first wall and the second wall, wherein the accessory structure includes a slot that fits onto the bar, wherein the slot includes an entry portion for receiving the bar and a lock portion for orientating and locking the accessory structure within the corner.

2. The shower assembly as recited in claim 1, wherein the mount comprises a first bar and a second bar both extending diagonally across the corner, and the accessory structure includes first and second slots for receiving the first and second bars.

3. The shower assembly as recited in claim 1, wherein the first wall and the second wall form a non-liner shape across the corner and the accessory structure includes a surface that corresponds with the non-linear shape within the corner.

4. A shower assembly comprising:

a mount bracket configured for attachment to a fixed structure supporting the shower assembly;

a shower wall including a curvilinear contoured portion defining a periphery, wherein the a portion of the mount bracket overlaps the shower wall when installed;

a mount disposed within the periphery and mounted to the mount bracket, wherein the mount comprises arms extending outwardly from the shower wall within the contoured portion defining slots; and an accessory structure removably supported within the slots defined by the arms extending from the shower wall, the accessory structure including a portion received within the slots and a shape corresponding with the curvilinear contoured portion such that the accessory structure fits within the defined periphery.

5. The shower assembly as recited in claim 4, wherein the accessory structure includes a minor.

6. The shower assembly as recited in claim 4, wherein the accessory structure includes a covered compartment.

7. The shower assembly as recited in claim 4, wherein the accessory structure includes a clock radio.

* * * * *